US010159360B2

(12) United States Patent
Bryson et al.

(10) Patent No.: US 10,159,360 B2
(45) Date of Patent: Dec. 25, 2018

(54) STACKED CAN MERCHANDISER

(71) Applicant: Process Retail Group, Inc., New Berlin, WI (US)

(72) Inventors: M. Scott Bryson, Brookfield, WI (US); Terrence G. Berglund, Hales Corners, WI (US); Daniel Momsen, Shorewood, WI (US)

(73) Assignee: Process Retail Group, Inc., New Berlin, WI (US)

( * ) Notice: Subject to any disclaimer, the term of this patent is extended or adjusted under 35 U.S.C. 154(b) by 0 days.

(21) Appl. No.: 15/362,885

(22) Filed: Nov. 29, 2016

(65) Prior Publication Data

US 2017/0164762 A1 Jun. 15, 2017

Related U.S. Application Data

(63) Continuation of application No. 29/543,222, filed on Oct. 22, 2015.

(51) Int. Cl.

| | |
|---|---|
| ***A47F 1/12*** | (2006.01) |
| ***A47F 5/00*** | (2006.01) |
| ***A47F 7/28*** | (2006.01) |

(52) U.S. Cl.

CPC ..... *A47F 1/126* (2013.01); *A47F 5/005* (2013.01); *A47F 5/0025* (2013.01); *A47F 7/281* (2013.01)

(58) Field of Classification Search

CPC ..... A47F 1/126; A47F 5/005; A47F 7/007; A47F 7/28; A47F 1/00; A47F 1/04; A47F 1/125; A47F 3/02; A47F 5/10; A47F 7/281; A47F 5/0025; A47B 57/58; A47B 73/00; A47B 65/10; A47B 65/15; A47B 45/00

USPC ..... 211/59.3, 184, 175, 74, 194

See application file for complete search history.

(56) References Cited

U.S. PATENT DOCUMENTS

| | | | | |
|---|---|---|---|---|
| 3,452,959 A * | 7/1969 | Ishikawa | ..... | A47F 5/0815 248/220.31 |
| 4,724,968 A * | 2/1988 | Wombacher | ..... | A47F 5/005 211/184 |
| 4,830,201 A * | 5/1989 | Breslow | ..... | A47F 1/126 211/184 |

(Continued)

OTHER PUBLICATIONS

Process Retail Group; Drawing Revision No. 1; 7 pages; dated Jul. 9, 2013.

(Continued)

*Primary Examiner* — Jennifer E. Novosad

(74) *Attorney, Agent, or Firm* — Boyle Fredrickson, S.C.

(57) ABSTRACT

A stacked can merchandiser includes a floor component. The floor component has a glide surface allowing movement of merchandise, a plurality of engagement tabs disposed on the sides of the floor component, and a plurality of interfit spaces disposed on the sides of the floor component. The plurality of engagement tabs has a thickness equal to a thickness of the track component, and at least one engagement tab includes a snap lock feature disposed thereon. At least one of the interfit spaces includes a snap lock feature. The stacked can merchandiser further includes a divider extending upwardly from the track component. At least one finger element is disposed at a front edge of the divider and extends laterally therefrom. At least one pusher element is coupled to the divider and configured to travel along a length of the divider.

20 Claims, 8 Drawing Sheets

(56) References Cited

U.S. PATENT DOCUMENTS 4,901,869 A * 2/1990 Hawkinson ..... A47F 1/126 211/184
5,240,126 A * 8/1993 Foster ..... A47F 1/126 211/175
5,265,738 A * 11/1993 Yablans ..... A47F 1/126 211/184
5,366,099 A * 11/1994 Schmid ..... A47F 1/126 211/175
5,458,248 A * 10/1995 Alain ..... A47B 45/00 211/153
5,685,664 A * 11/1997 Parham ..... A47F 1/126 211/59.3
5,775,046 A * 7/1998 Fanger ..... A47B 81/06 108/157.16
5,788,091 A * 8/1998 Robertson ..... A47F 7/285 211/59.2
5,806,690 A * 9/1998 Johnson ..... A47F 1/126 211/175
5,904,256 A * 5/1999 Jay ..... A47F 5/0025 211/175
6,129,218 A * 10/2000 Henry ..... A47F 1/126 211/59.3
6,357,606 B1 * 3/2002 Henry ..... A47F 1/126 211/184
6,523,703 B1 * 2/2003 Robertson ..... A47F 1/126 211/51
6,655,536 B2 * 12/2003 Jo ..... A47F 1/126 211/184
6,705,472 B2 * 3/2004 Cross ..... G11B 23/0236 211/126.2
6,779,670 B2 * 8/2004 Primiano ..... A47F 1/12 211/175
6,886,699 B2 5/2005 Johnson et al.
7,124,898 B2 * 10/2006 Richter ..... A47F 1/12 211/59.3
7,168,579 B2 1/2007 Richter et al.
D542,055 S * 5/2007 Wilenius ..... D6/705
7,458,473 B1 * 12/2008 Mason ..... A47F 1/126 211/175
7,854,333 B2 * 12/2010 Kottke ..... A47F 1/12 211/59.2
8,172,094 B2 * 5/2012 Meyer ..... A47F 5/005 211/134
8,627,965 B2 * 1/2014 Hardy ..... A47F 1/126 211/184
8,939,421 B1 * 1/2015 Bryson ..... A47F 1/04 211/59.2
8,967,393 B2 3/2015 Bryson et al.
9,103,580 B2 * 8/2015 Bryson ..... A47F 5/10
9,433,305 B2 * 9/2016 Bird ..... A47F 1/04
9,451,836 B2 * 9/2016 Szpak ..... A47F 1/04
9,486,089 B1 * 11/2016 Ng ..... A47F 1/126
9,504,321 B2 11/2016 Hardy
9,723,933 B2 * 8/2017 Howard ..... A47F 1/125
9,788,665 B2 * 10/2017 Howard ..... A47F 1/125
2003/0057167 A1 * 3/2003 Johnson ..... A47F 1/126 211/59.3
2003/0217980 A1 * 11/2003 Johnson ..... A47F 1/126 211/59.3
2005/0189310 A1 * 9/2005 Richter ..... A47F 1/12 211/59.3
2007/0241070 A1 * 10/2007 Maheu ..... A47F 5/0815 211/59.1
2007/0272634 A1 11/2007 Richter et al.
2008/0156752 A1 * 7/2008 Bryson ..... A47F 1/126 211/59.3
2014/0138330 A1 * 5/2014 Hardy ..... A47F 1/126 211/59.3
2016/0150894 A1 * 6/2016 Howard ..... A47F 1/126 211/59.3
2017/0164762 A1 * 6/2017 Bryson ..... A47F 1/126

OTHER PUBLICATIONS

Process Retail Group; Drawing Revision No. 2; 2 pages; dated Aug. 9, 2013.
Process Retail Group; Drawing Revision No. 3; 7 pages; dated Sep. 26, 2013.
Process Retail Group; Drawing Revision No. 4; 8 pages; dated May 19, 2014.
Process Retail Group; Drawing Revision No. 5; 2 pages; dated Jun. 5, 2014.
Process Retail Group; Drawing Revision No. 6; 7 pages; dated Nov. 7, 2014.
Process Retail Group; Drawing Revision No. 7; 7 pages; dated Feb. 5, 2015.
Process Retail Group; Drawing Revision No. 8; 7 pages; dated Mar. 25, 2015.
Process Retail Group; Drawing Revision No. 9; 7 pages; dated May 13, 2015.
Process Retail Group; Drawing Revision No. 10; 7 pages; dated Jul. 1, 2015.
Process Retail Group; Drawing Revision No. 11; 7 pages; dated Aug. 10; 2015.
Process Retail Group; Drawing Revision No. 12; 7 pages; dated Sep. 11, 2015.
Process Retail Group; Drawing Revision No. 13; 7 pages; dated Sep. 23, 2015.

* cited by examiner

STACKED CAN MERCHANDISER

CROSS-REFERENCE TO RELATED APPLICATION

This application is a continuation of U.S. application Ser. No. 29/543,222, filed on Oct. 22, 2015, the entire contents of which are hereby expressly incorporated by reference into the present application.

BACKGROUND OF THE INVENTION

1. Field of the Invention

The present invention relates generally to the field of merchandising system. In particular, the present invention relates to a stacked can merchandiser having features that improve stackability and presentation of canned merchandise.

2. Discussion of the Related Art

There are two current systems for stocking canned merchandise in a consumer setting, such as a grocery store, retail outlet, shop, and the like. The first system is to manually stack canned merchandise on the shelf unit, which requires large amounts of in-store labor to continuously reorganize the canned merchandise.

The second system is merchandising systems that may be used to present, display, and store articles in the fixed or limited space provided on the shelf. Since shelf space is limited, the merchandising system must be able to maximize the space used for canned merchandise. In addition, the shelf space may vary from store to store. Therefore, a merchandising system must be adaptable to the varying needs of stores. As such, there is a need in the art for an improved stacked can merchandiser that maximizes space management by including the coupling device of components within the floor of the stacked can merchandiser. Further, there is a need in the art for an improved stacked can merchandiser that may easily attach and detach additional sections in order to work with different shelf space sizes in varying stores.

In addition, merchandising systems in the art teach indiscriminately moving merchandise to the front of shelf. That is, there is no regard for self-facing the label of the merchandise in order for the customer to easily identify the product. Consequently, there is a need in the art for an improved stacked can merchandiser having a pushing element that acts as a self-facing feature that improves presentation of the canned merchandise, while maintaining the canned merchandise in an organized stack. As a result, the canned merchandise is easier to stock and shop by the customer.

SUMMARY AND OBJECTS OF THE INVENTION

By way of summary, the present invention is directed to a stack canned merchandiser having features that improve stackability and presentation of canned merchandise.

According to one embodiment of the invention, a stacked can merchandiser includes a floor component, a plurality of engagement tabs that are disposed on the sides of the floor component, and a plurality of interfit spaces disposed on the sides of the floor component. The floor component has a glide surface allowing movement of merchandise. The engagement tabs have a thickness equal to a thickness of the floor component, and at least one of the engagement tabs includes a snap lock feature disposed thereon. The stacked can merchandiser further includes a divider that extends upwardly from the floor component. At least one finger element is disposed at a front edge of the divider and extends laterally therefrom. At least one pusher element is coupled to the divider and is configured to travel along a length of the divider.

In accordance with another embodiment of the invention, a stacked can merchandiser system includes a first floor component having a first upper glide surface allowing movement of merchandise. A first plurality of engagement tabs is disposed on the sides of the first floor component. The engagement tabs have a thickness equal to a thickness of the first floor component, and at least one of the engagement tabs includes a snap lock feature disposed thereon. A first plurality of interfit spaces is disposed on the sides of the first floor component, and at least one of the interfit spaces includes a snap lock feature disposed thereon. A first divider extends upwardly from the first floor component. The first floor component further includes a first finger element that is disposed at a front edge of the first divider and extending laterally therefrom, and a plurality of first retaining tabs that are disposed at the front edge of the first divider and extend laterally therefrom. The plurality of first retaining tabs is spaced vertically along the front edge of the first divider and below the first finger element. A first pusher element is coupled to the first divider and configured to travel along a length of the first divider.

Additionally, the stacked can merchandiser system includes a second floor component having a second upper glide surface allowing movement of merchandise. A second plurality of engagement tabs is disposed on the sides of the second floor component. The engagement tabs have a thickness equal to a thickness of the second floor component, and at least one engagement tab includes a snap lock feature disposed thereon. A second plurality of interfit spaces is disposed on the sides of the second floor component, and at least one interfit space includes a snap lock feature disposed thereon. A second divider extends upwardly from the second floor component. The second track component also includes a second finger element that is disposed at a front edge of the second divider and extends laterally therefrom, and a plurality of second retaining tabs that is disposed at the front edge of the second divider and extend laterally therefrom. The plurality of second retaining tabs is spaced vertically along the front edge of the second divider and below the second finger element. A second pusher element is coupled to the second divider and configured to travel along a length of the second divider. The snap lock feature of the at least one of the first plurality of engagement tabs is configured to interlock with the snap lock feature of the at least one of the second plurality of interface spaces to couple the first and second floor components. In addition, the snap lock feature of the at least one of the first plurality of interface spaces is configured to interlock with the snap lock feature of the at least one of the second plurality of engagement tabs to couple the first and second floor components.

According to yet another embodiment of the invention, a method of using a stacked can merchandising system to display canned merchandise includes providing a first floor component, coupling a second floor component to the first floor component, coupling a first divider to the first floor component, and coupling a second divider to the second floor component so that canned merchandise may be stacked between the first divider and the second divider. In order to couple the second floor component to the first floor component, a plurality of engagement tabs of the first floor component interfit with a plurality of interfit spaces of the second floor component, and a plurality of interfit spaces of the first floor component interfit with a plurality of engagement tabs of the second track component. The method further includes stacking canned merchandise in a plurality of stacks between the first divider and the second divider, pushing a first stack of the plurality of stacks of canned merchandise to a front edge of the first and second floor components by way of a pusher element that is slidably engaged with one of the first divider and the second divider, and stopping the canned merchandise at the front edge of the first and second floor components by way of at least one finger element and a plurality of retaining tabs that is disposed at each front edge of the first and second dividers. The at least one finger element and the plurality of retaining tabs are vertically spaced along each front edge of the first and second dividers.

These, and other aspects and objects of the present invention, will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical embodiments of the present invention, will become more readily apparent by referring to the exemplary, and, therefore, non-limiting, embodiments illustrated in the drawings accompanying and forming a part of this specification, wherein like reference numerals designate the same elements in the several views, and in which.

Figure 1:
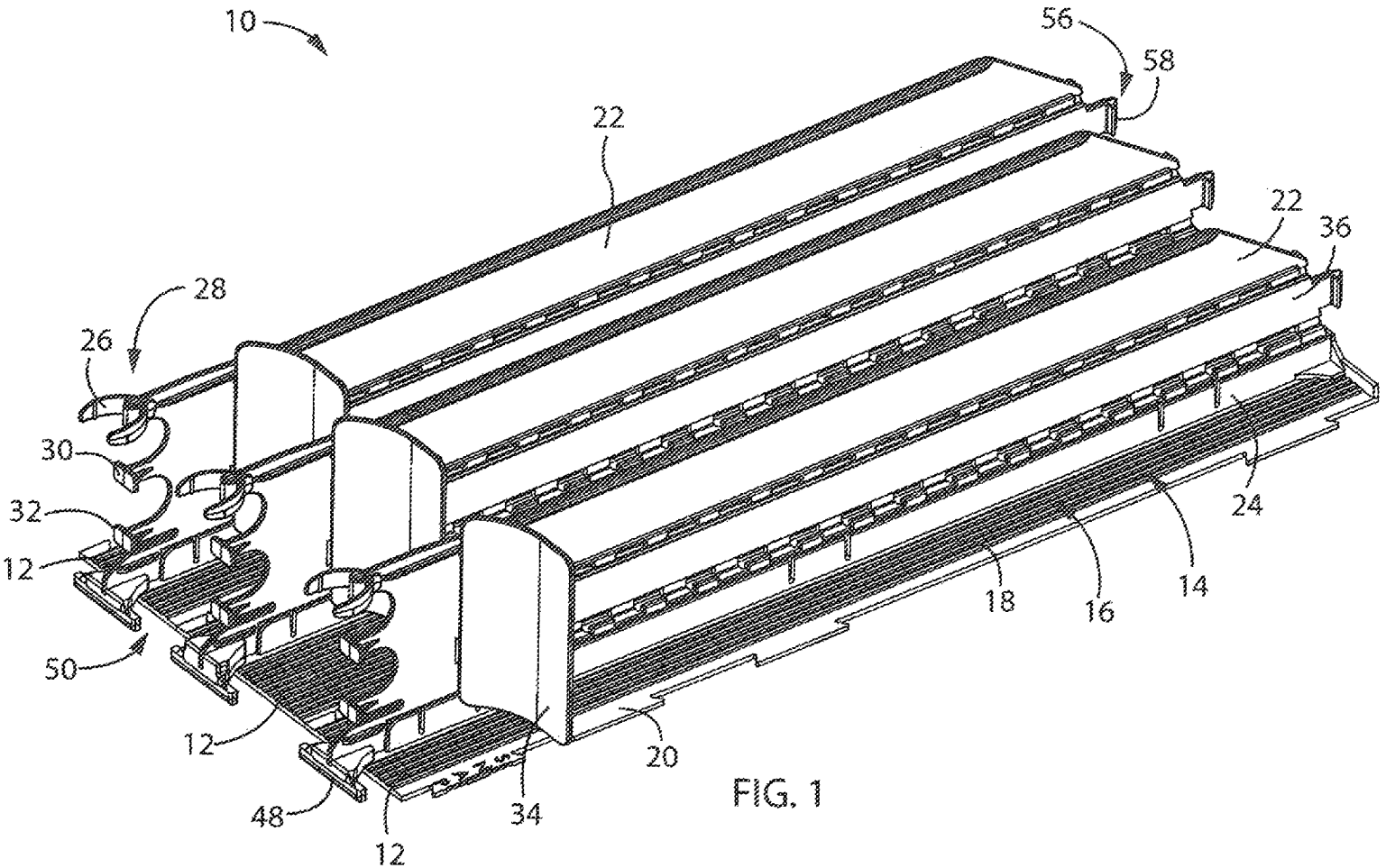
FIG. 1 is a perspective view of an improved stacked can merchandiser, according to an embodiment of the invention.

In describing preferred embodiments of the invention, which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose.

DETAILED DESCRIPTION OF THE DRAWINGS

The present invention and the various features and advantageous details thereof are explained more fully with reference to the non-limiting embodiments described in detail in the following description.

Referring first to FIG. 1, a perspective view of an improved stacked can merchandiser 10 is shown. The inventive stacked can merchandiser 10 includes at least one floor component 12. While FIG. 1 depicts the stacked can merchandiser 10 including three (3) floor components 12, it is contemplated that the invention may include any number of floor components 12. That is, floor components 12 may be added or subtracted from the stacked can merchandiser 10 in order to adjust the width of the overall system to fit on a store shelving unit and merchandise planogram (POG).

Each floor component 12 includes a glide surface 14 on the top surface 16 of the floor component 12. In the representative embodiment of the invention, the glide surface 14 includes a plurality of ridges 18. The glide surface 14 and plurality of ridges 18 are designed and configured so as to allow smooth, directed gliding of canned merchandise 52 along a length of the floor component 12. A stopping element 48 is placed at a leading end 50 of the floor component 12 in order to keep the canned merchandise 52 from sliding off of the floor component 12.

Additionally, each floor component 12 preferably includes a plurality of engagement tabs 20. As seen in the FIGS., the engagement tabs 20 of one floor component 12 are configured to interfit with the engagement tabs 20 of another floor component 12 in order to couple at least two (2) floor components 12 together. While the figures illustrate a plurality of engagement tabs 20 on each side of the floor component 12, it is contemplated that each side of the floor component 12 may include one (1) or more engagement tabs 20. The interfitting of the engagement tabs 20 between adjacent floor components 12 will be described in further detail later with respect to FIGS. 11-14.

Each floor component 12 may also include a divider 22 that extends vertically from the floor component 12. In the representative embodiment of the invention, the divider 22 is coupled to a divider support 24, which extends vertically from the top surface 16 of the floor component 12. The divider support 24 may be integrally formed with the floor component 12, or may be a separate piece coupled thereto. In addition, the divider support 24 is configured so as to orient the divider 22 in the vertical direction.

FIG. 1 further illustrates at, least one finger element 26 disposed on a front edge 28 of each divider 22. The finger element 26 extends laterally from the front edge 28 of the divider 22. While the representative embodiment of the invention contemplates the use of a flexible finger element 26, it is also contemplated that a rigid finger element 26 may be used. Additionally, a first retaining tab 30 and a second retaining tab 32 may be disposed on the front edge 28 of each divider. The first and second retaining tabs 30, 32 are vertically spaced along the front edge 28 of the divider 22 and extend laterally therefrom. As shown in FIG. 1, the first and second retaining tabs 30, 32 are located below the finger element 26. In other words, the finger element 26 and first and second retaining tabs 30, 32 are configured to extend beyond the sides of the divider 22. While the representative embodiment of the invention includes a single finger element 26 disposed on the front edge 28 of each divider 22, any number of finger elements 26 may be used. Similarly, while the representative embodiment of the invention includes a first retaining tab 30 and a second retaining tab 32, it is contemplated that more or less than two (2) retaining tabs may be disposed on the front edge 28 of each divider 22. FIG. 1 further illustrates that the finger element 26 is larger in size than the first and second retaining tabs 30, 32. That is, the finger element 26 extends further laterally than the first and second retaining tabs 30, 32. In this instance, the finger element 26 is able to put larger resistive force on a stack of canned merchandise than the retaining tabs 30, 32, which helps the stack of canned merchandise 52 maintain its organized configuration. However, it is also contemplated that the finger element 26 may be similar in shape and size to the retaining tabs 30, 32, in other embodiments of the invention. The shape of the finger element 26 and the retaining tabs 30, 32 in the representative embodiment of the invention will be further described with respect to FIG. 10.

Further, a pusher element 34 is slidably coupled to each divider 22. In the representative embodiment of the invention, the divider 22 includes a track channel 36 formed in a side surface 38 of the divider 22. As shown in greater detail in FIG. 8, the pusher element 34 includes a tab 40 configured to slidably engage with the track channel 36 and allow the tab 40 and pusher element 34 to move along the length of the track channel 36. Additionally, a rear edge 56 of the channel 36 of the divider 22 may include a stopping tab 58 to provide a rear stopping point for the pusher element 34. In the representative embodiment of the invention, the stopping tab 58 is configured to provide a stopping point for the tab 40. That is, when the tab 40 reaches the stopping tab 58, the tab 40 is prevented from moving any farther back, which results in the attached pusher element 40 being prevented from moving any farther back. As will be described in further detail later, a spring element 42 may also be coupled to the pusher element 34 and configured to automatically move the pusher element 34 forward.

As shown in the FIGS., the pusher element 34 may be generally arc-shaped, which is designed to match the contour of the canned merchandise 52. While the representative embodiment of the invention depicts the pusher element 34 as being generally arc-shaped, it is also contemplated that the pusher element 34 may have any other shape, such as, but not limited to, a flat tangential surface, a multi-angled surface, and the like.

Figure 2:
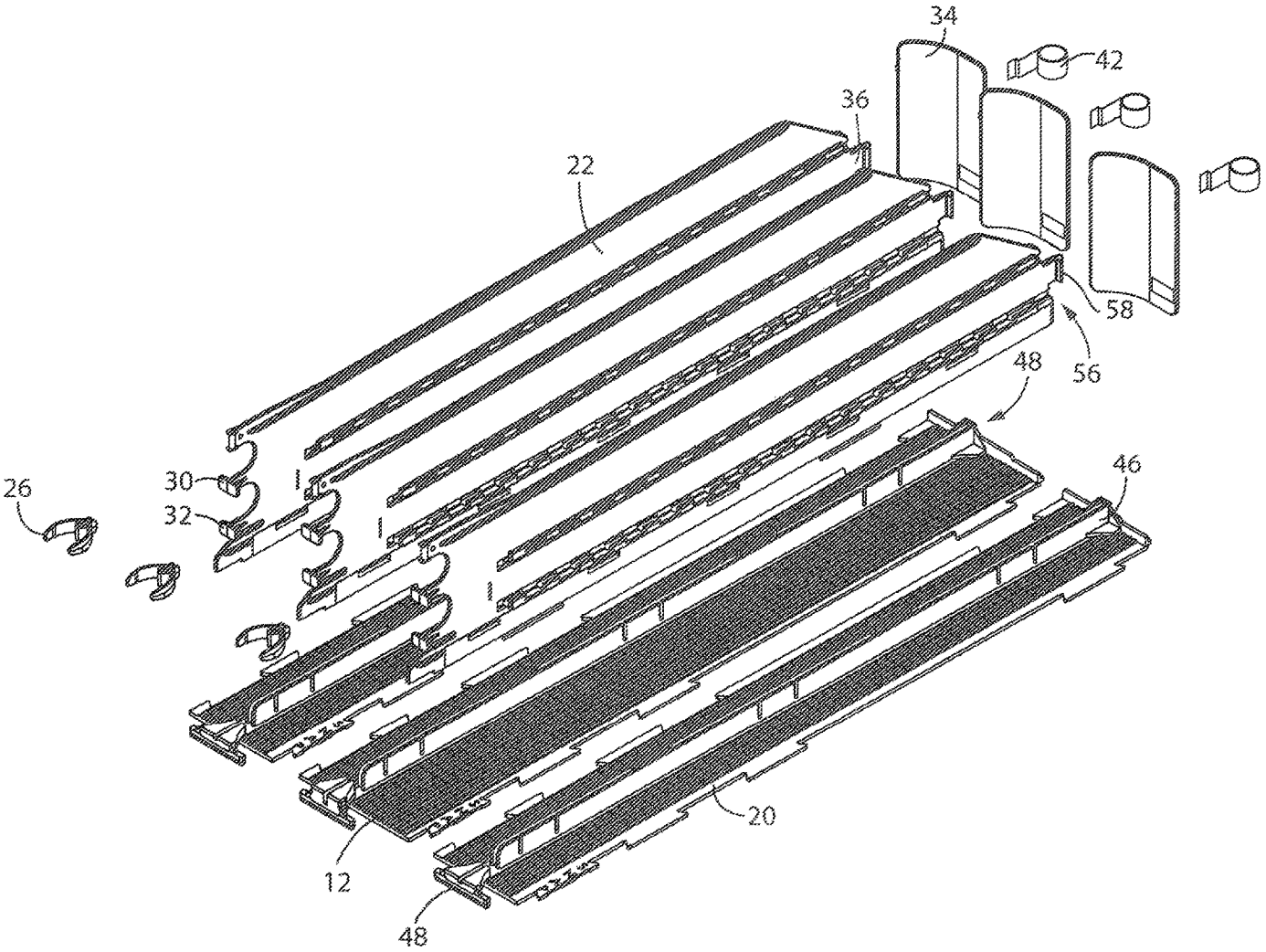
FIG. 2 is an exploded isometric view of the improved stacked can merchandiser of FIG. 1, according to an embodiment of the invention.

Next, FIG. 2 shows an exploded isometric view of the stacked can merchandiser 10. As previously discussed, FIG. 2 depicts the interlining of the engagement tabs 20 of adjacent floor components 12. As will be described in further detail later, a number of the engagement tabs 20 may include a snap lock feature. This exploded isometric view also illustrates the representative embodiment of the divider support 24 for each floor component 12. As shown in FIG. 2, the divider support 24 includes a channel 44 disposed between two (2) vertical sections 46. As such, the channel 44 is configured to receive the divider 22.

Figure 3:
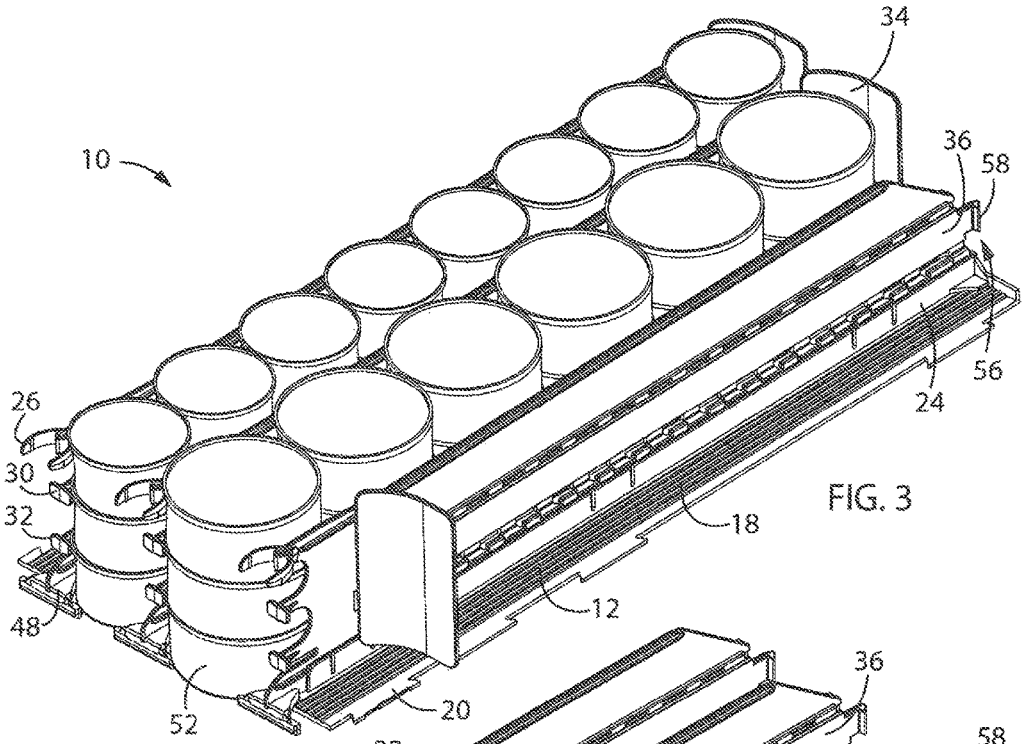
FIG. 3 is a perspective view of the improved stacked can merchandiser of FIG. 1 including a plurality of stacks of canned merchandise, according to an embodiment of the invention.

Referring now to FIG. 3, a perspective view of the stacked can merchandiser 10 is shown with a plurality of stacks of canned merchandise 52. As shown, the canned merchandise 52 is stacked between the dividers 22 in a stacking area 54. As more stacks of canned merchandise 52 are placed in the stacking area 54, the pusher element 34 is moved backward to accommodate the stacks of canned merchandise 52. The spring element 42 coupled to the pusher element 34 ensures that the pusher element 34 is in contact with the last stack of canned merchandise 52. Additionally, the finger element 26, retaining tabs 30, 32, and stopping element 48 previously described above prevent the canned merchandise 52 from being pushed off the front of the stack can merchandiser 10 by the pusher element 34.

Figure 4:
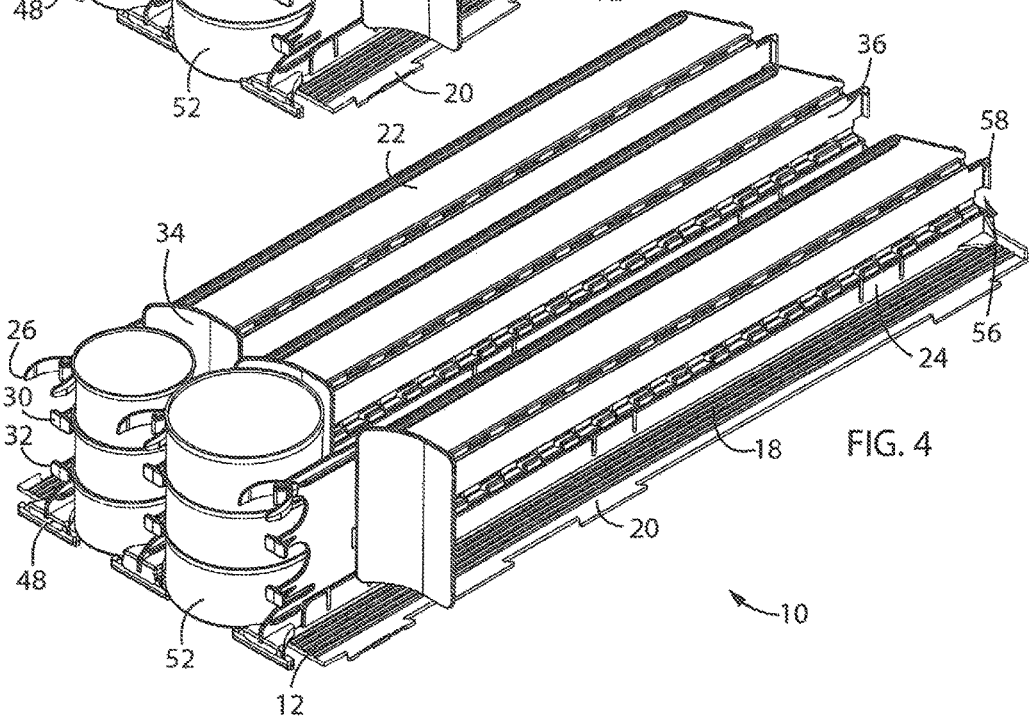
FIG. 4 is a perspective of the improved stacked can merchandiser of FIG. 1 including a single stack of canned merchandise in each row, according to an embodiment of the invention.

FIG. 4 next shows a perspective view of the stacked can merchandiser 10 with only a single stack of canned merchandise 52. Since the stacking area 54 only includes a single stack of canned merchandise 52, the pusher element 34 has been automatically moved forward to be in contact with the single stack of canned merchandise 52.

According to the representative embodiment, the tension created by the spring element 42 automatically moves the pusher member 34 forward until the front stack of canned merchandise 52 is in contact with the finger elements 26, retaining tabs 30, 32, and the stopping elements 48, and the subsequent stacks of canned merchandise 52 are in contact with adjacent stacks of canned merchandise 52. In other words, when a front stack of canned merchandise 52 is removed from the stacking area 54, the pusher element 34 automatically moves the remaining stacks of canned merchandise 52 to the front of the stacking area 54 along the glide surface 14.

As described above, the pusher element 34 may be configured in a shape that generally matches the contour of the canned merchandise 52. This feature allows the canned merchandise 52 to be presented to the front of the stacked can merchandiser 10 without rotating the canned merchandise 52. As a result, the stacked can merchandiser 10 is able to self-face the canned merchandise 52 and maintain easy identification of the canned merchandise 52 by not rotating the canned merchandise 52 as it is pushed forward.

Figure 5:
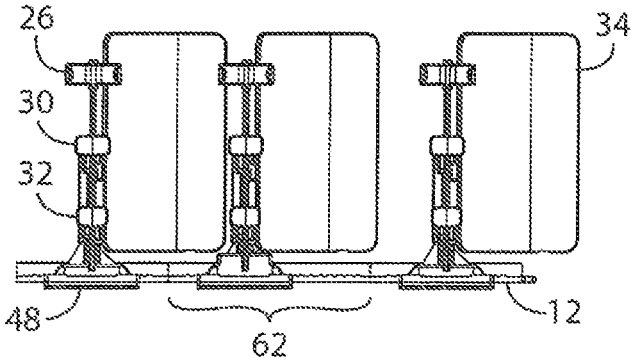
FIG. 5 is a front view of the improved stacked can merchandiser of FIG. 1, according to an embodiment of the invention.
Figure 6:
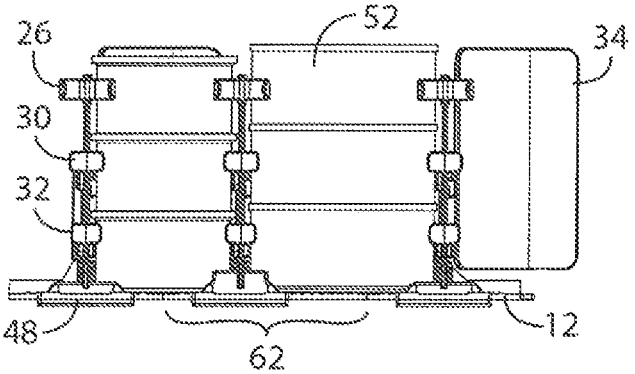
FIG. 6 is a front view of the improved stacked can merchandiser of FIG. 1 including at least one stack of canned merchandise, according to an embodiment of the invention.

Next FIGS. 5 and 6 show a front view of the stacked can merchandiser 10 with and without at least one stack of canned merchandise 52, respectively. As previously discussed, the finger element 26 and retaining tabs 30, 32 are vertically spaced along the front edge 28 of the divider 22 and extend laterally therefrom, As shown in FIGS. 5 and 6, the width 62 of each floor component 12 may vary throughout the stacked can merchandiser, As a result, the stacked can merchandiser may include stacking areas 54 with varying widths that may fit canned merchandise 52 of varying sizes.

Figure 7:
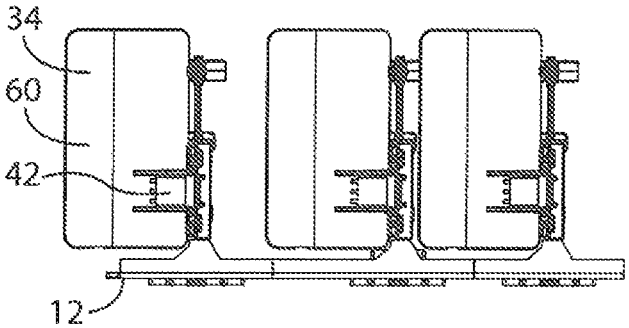
FIG. 7 is a rear view of the improved stacked can merchandiser of FIG. 1, according to an embodiment of the invention.

FIG. 7 illustrates a rear view of the stacked can merchandiser 10. As described earlier, the spring element 42 is coupled to the pusher element 24. In the representative embodiment of the invention, the spring element 42 is coupled to the rear surface 60 of the pusher element 24. As a result, the tension created by the spring element 42 exerts a force on the rear surface 60 of the pusher element 24, which moves the pusher element 42 forward, for example, as canned merchandise 52 is removed from the front of the glide surface 14.

Figure 8:
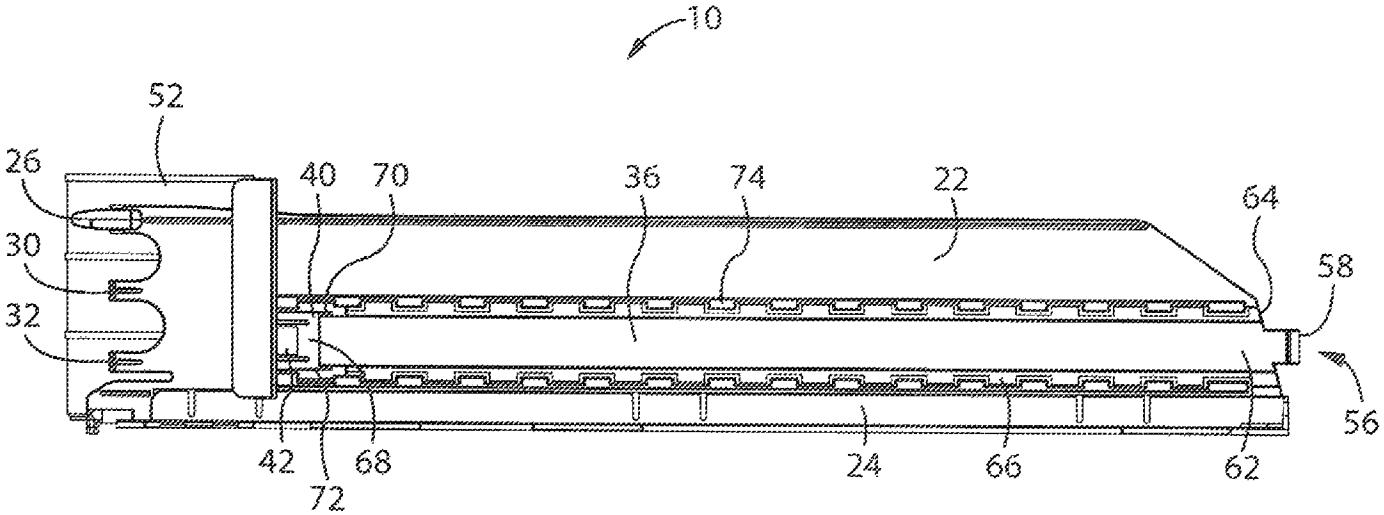
FIG. 8 is a side view of the improved stacked can merchandiser of FIG. 1 including a single stack of canned merchandise, according to an embodiment of the invention.

Now referring to FIG. 8, a side view of the stacked can merchandiser 10 illustrates the channel 36 formed in the side surface 38 of the divider 22. As previously described, the pusher member 34 includes a tab 40 that is configured to slidably engage with the channel 36 of the divider 22, along the length of the channel 36. As shown in FIG. 8, the channel 36 may include a raised portion 62, a first recessed portion 64, and a second recessed portion 66. In this instance, the tab 40 may be configured to interfit with the raised portion 62 and recessed portions 64, 66. That is, the tab 40 may include a raised portion 68 configured to receive the raised portion 62 of the channel 36, a first lowered portion 70 to be received by the first recessed portion 64 of the channel 36, and a second lowered portion 72 to be received by the second recessed portion 66 of the channel 36.

While the representative embodiment of the invention illustrates the channel 36 having one (1) raised portion 62 and two (2) recessed portions 64, 66, it is contemplated that the channel 36 may include any number of raised portions 62, including none, and any number of recessed portions 64, 66, including none.

Further, the divider 22 may include clips 74 configured to keep the tab 40 slidably engaged with the channel 36 along the length of the channel 36. While FIG. 8 depicts the channel 36 extending along the divider 22 for less than the total length of the divider 22, it is contemplated that, in alternative embodiments of the invention, the channel 36 may extend along the entire length of the divider 22 or any length shorter than the entire length of the divider 22.

Figure 9:
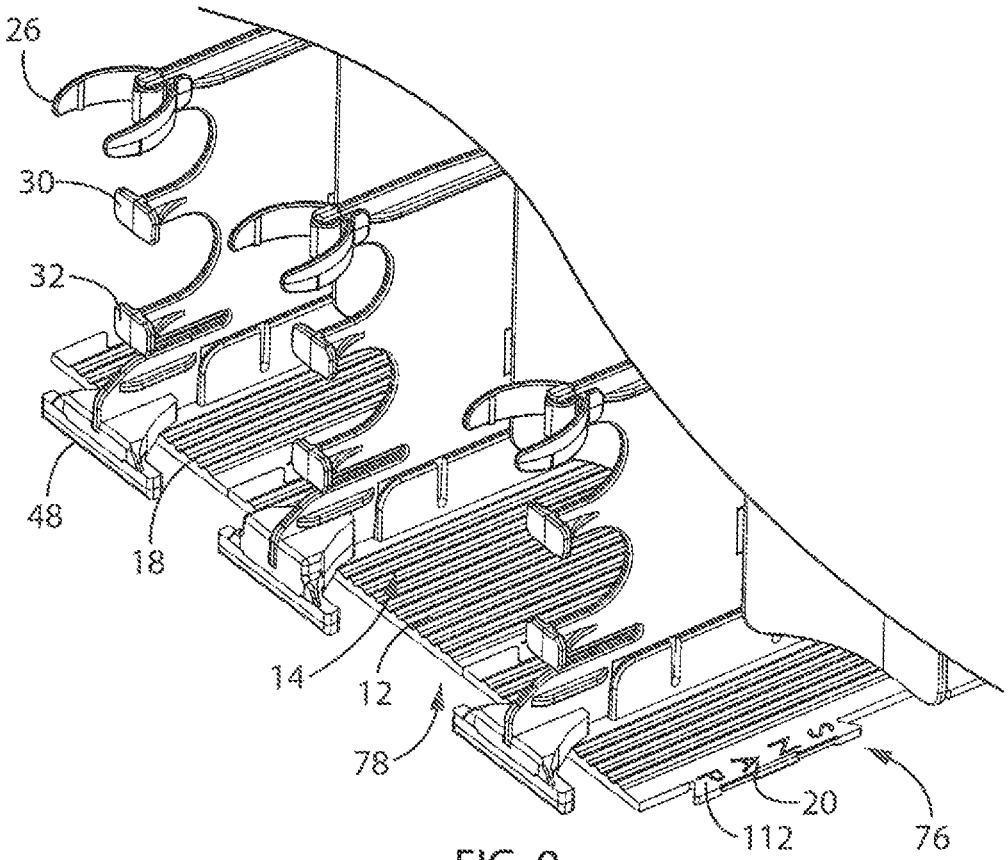
FIG. 9 is an enlarged perspective view of a first end of the improved stacked can merchandiser of FIG. 1, according to an embodiment of the invention.

Now referring to FIG. 9, an enlarged perspective view of the front end of the improved stacked can merchandiser 10 is shown. In the preferred embodiment of the invention, the thickness 76 of the engagement tabs 20 is the same as the thickness 78 of the floor component 12. As such, the engagement tabs 20 used to couple together adjacent track components 12 may be located below the stacking area 54 without interfering with movement of the canned merchandise 52. FIG. 9 also provides a clearer depiction of the ridges 18 of the glide surface 14 of the floor component 12, as previously described. Also, an indicia 112 may be provided on one (1) or more of the engagement tabs 20 (e.g., S-N-A-P) to aid the user in assembling the floor components 12.

Figure 10:
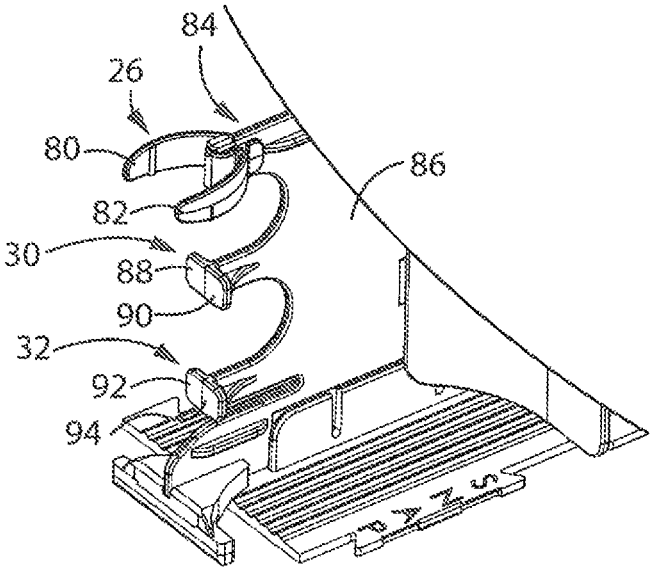
FIG. 10 is an enlarged partial perspective view of the flexible finger element and retaining tabs of the improved can merchandiser of FIG. 1, according to an embodiment of the invention.

Next, FIG. 10 illustrates an enlarged perspective view focusing on the finger element 26 and the retaining tabs 30, 32 disposed on the front edge 26 of each divider 22. According to the representative embodiment of the invention, each finger element 26 includes a first prong 80 and a second prong 82. The first prong 80 is disposed at the front edge 26 of the divider 22 and extends outwardly from the first side 84 of the divider 22. Similarly, the second prong 82 is disposed at the front edge 26 of the divider 22 and extends outwardly from the second side 86 of the divider 22.

As shown in FIGS. 4-8, the stopping element 48 disposed at the leading end 50 of the floor component 12 extends vertically below a bottom surface of the floor component 12. By extending below the bottom surface of the floor component 12, the stopping element 38 provides an overhang that interacts with the shelf upon which the merchandiser 10 is placed. For example, the stopping element 48 extends beyond the bottom surface of the floor component 12 and contacts the front of a shelf. In turn, the merchandiser 10 is prevented from being pushed toward the back of the shelf while a user loads the merchandiser 10.

In addition, the first retaining tab 30 includes a first extension 88 and a second extension 90. The first extension 88 is disposed at the front edge 26 of the divider 22 and extends outwardly from the first side 84 of the divider 22. The second extension 90 is disposed at the front edge 26 of the divider 22 and extends outwardly from the second side 86 of the divider 22. Likewise, the second retaining tab includes a first extension 92, which is disposed at the front edge 26 of the divider 22 and extends outwardly from the first side 84 of the divider 22, and a second extension 94, which is disposed at the front edge 26 of the divider 22 and extends outwardly from the second side 86 of the divider 22.

As shown in FIG. 10, the finger element 26 may extend beyond the retaining tabs 30, 32 in order to provide adequate resistive force to hold the entire stack of canned merchandise 52 at the front of the stacked can merchandiser 10. However, it is also contemplated that the finger element 26 extends the same as or less than, the retaining tabs 30, 32. Further, while the representative embodiment of the invention shows the first and second prongs 80, 82 having an arc shape and the first and second extensions 88, 90, 92, 94 having a planar surface, it is also contemplated that the first and second prongs 80, 82 may be shaped similar to the first and second extensions 88, 90, 92, 94 and vice versa. Of course, finger element 26 and retaining tabs 30, 32 may also be interchanged and located at different positions along the front edge 26 of the divider 22 in other embodiments of the invention.

The combination of finger elements 26, retaining tabs 30, 32, and stopping elements 48 also allow a user to remove less than the entire stack of canned merchandise 52, while maintaining the positioning of the stack of canned merchandise 52 on the glide surface 14 of the track components 12. That is, the stacks of canned merchandise 52 are not moved forward by the pusher element 24 until an entire stack of canned merchandise 52 is removed.

Figure 11:
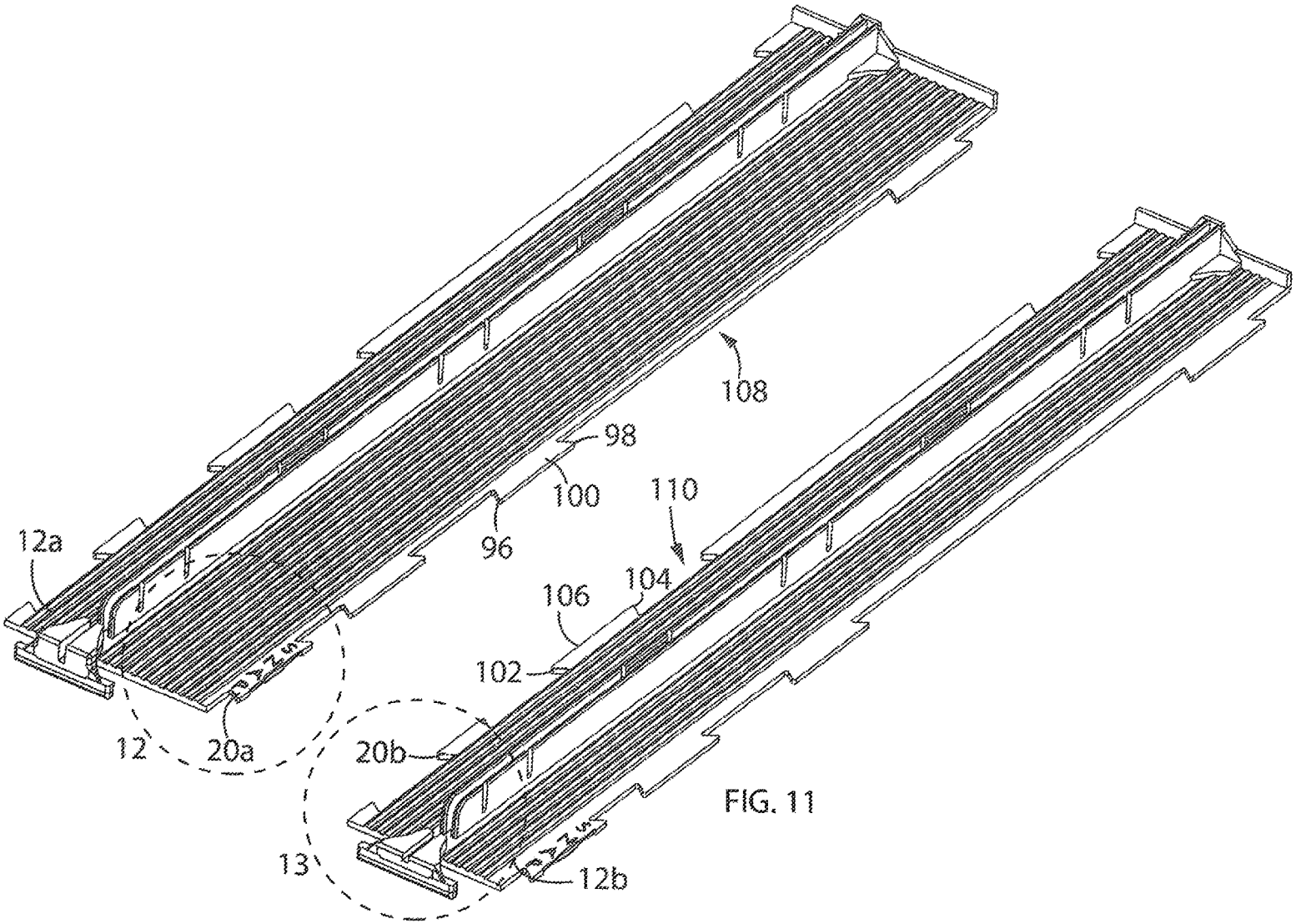
FIG. 11 is a perspective view of the engagement tabs of the improved can merchandiser of FIG. 1, according to an embodiment of the invention.

Referring now to FIG. 11, a perspective view of adjacent floor components 12 and their respective engagement tabs 20 is shown in order to illustrate how the plurality of engagement tabs 20 of adjacent floor components 12 interfit to couple the track components 12. In particular, FIG. 11 shows a first floor component 12*a* having a plurality of engagement tabs 20*a* and a second floor component 12*b* having a plurality of engagement tabs 20*b*. Each of the plurality of engagement tabs 20*a* of the first floor component 12*a* includes a first angled side 96, a second angled side 98, and a front side 100 extending therebetween. Similarly, each of the plurality of engagement tabs 20*b* of the first floor component 12*b* includes a first angled side 102, a second angled side 104, and a front side 106 extending therebetween. In the representative embodiment of the invention, the first angled side 96 of each of the first plurality of engagement tabs 20*a* is parallel to the second angled side 104 of each of the second plurality of engagement tabs 20*b*, and the second angled side 98 of each of the first plurality of engagement tabs 20*a* is parallel to the first angled side 102 of the second plurality of engagement tabs 20*b*.

Since the first plurality of engagement tabs 20*a* extends outward from the side of the first floor component 12*a*, an interfit space 108 is formed between adjacent ones of the first plurality of engagement tabs 20*a*. Likewise, since the second plurality of engagement tabs 20*b* extends outward from the side of the second floor component 12*b*, an interfit space 110 is formed between adjacent ones of the second plurality of engagement tabs 20*b*. As such, the interfit spaces 108 are configured to receive the second plurality of engagement tabs 20*b* and the interfit spaces 110 are configured to receive the first plurality of engagement tabs 20*a*, so as to allow the plurality of engagement tabs 20*a*, 20*b* to interfit with each other and couple the adjacent floor components 12*a*, 12*b*.

As shown in the representative embodiment of the invention, the first angled side 96 of one of the first plurality of engagement tabs 20*a* is aligned with the second angled side 104 of one of the second plurality of engagement tabs 20*b*, and the second angled side 98 of the same of the first plurality of engagement tabs 20*a* is aligned with the first angled side 102 of another of the second plurality of engagement tabs 20*b*. As a result, the above-referenced one of the first plurality of engagement tabs 20*a* of the first floor component 12*a* is aligned with a respective interfit space 110 of the second floor component 12*b*. Similarly, the first angled side 102 of one of the second plurality of engagement tabs 20*b* is aligned with the second angled wall 98 of one of the first plurality of engagement tabs 20*a*, and the second angled side 104 of the same of the second plurality of engagement tabs 20*b* is aligned with the first angled wall 96 of another of the first plurality of engagement tabs 20*a*. Consequently, the above-referenced one of the second plurality of engagement tabs 20*b* of the second floor component 12*b* is aligned with a respective interfit space 108 of the first floor component 12*a*.

As a result of the above, the plurality of engagement tabs 20*a* of the first floor component 12*a* is configured to interfit with the plurality of engagement tabs 20*b* of the second floor component 12*b* in order to interlock the first and second floor components 12*a*, 12*b* together.

Figure 13:
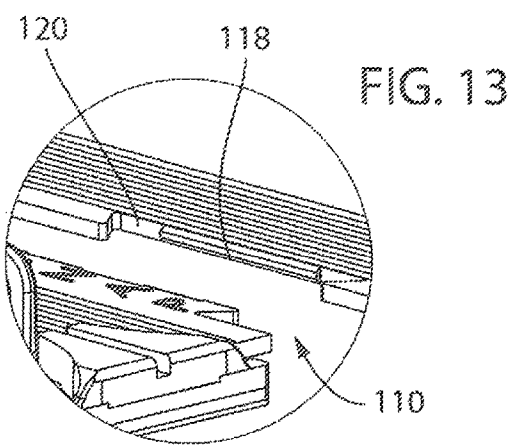
FIG. 13 is an enlarged perspective view of the snap lock feature of the interfit spaces of the improved can merchandiser of FIG. 1, according to an embodiment of the invention.
Figure 12:
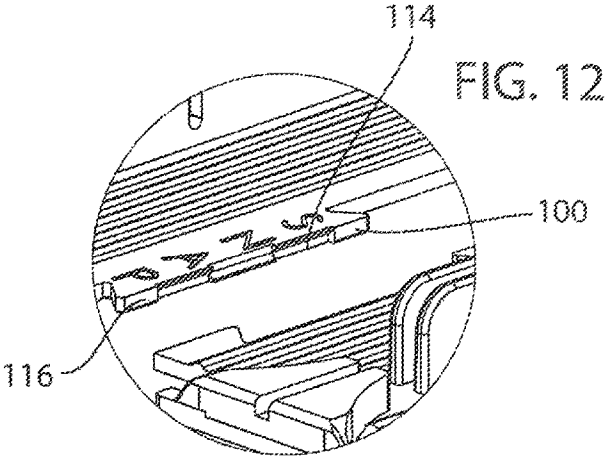
FIG. 12 is an enlarged perspective view of the snap lock feature of the engagement tabs of the improved can merchandiser of FIG. 1, according to an embodiment of the invention.
Figure 14:
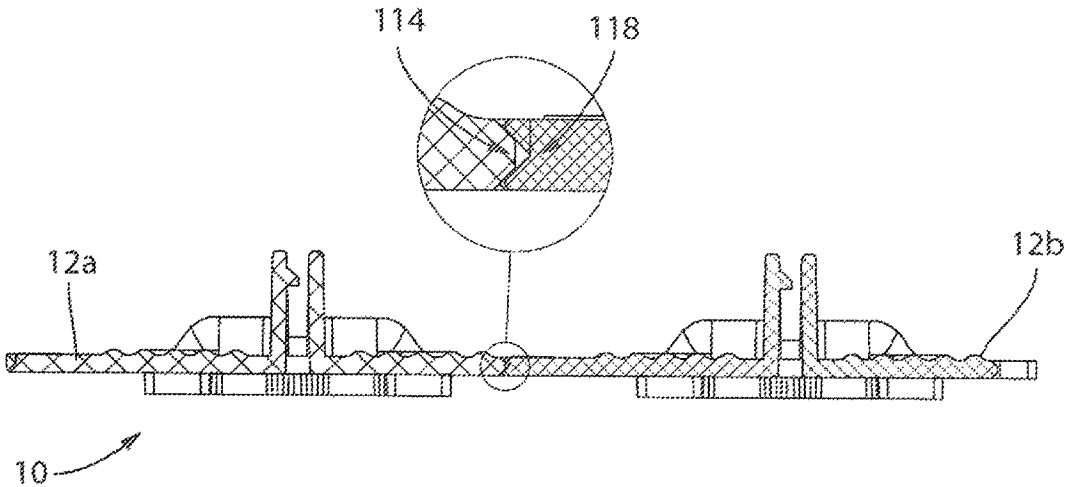
FIG. 14 is a cross-sectional view of the improved can merchandiser of FIG. 1 showing, according to an embodiment of the invention.

Next, FIG. 12 depicts an enlarged perspective view of the front engagement tab 20*c* of the floor component 12*a*. In particular, FIG. 12 illustrates a snap lock feature 114 formed in a side surface 116 of the front side 100 of the front engagement tab 20*a*. Meanwhile, FIG. 13 shows an enlarged perspective view of the front interfit space 110*b* of the floor component 12*b*. A snap lock feature 118 is formed in a side surface 120 of the front interfit space 110 of the engagement tab 20*b*. The snap lock features 114, 118 are configured to interfit with each other in order to secure the floor components 12*a*, 12*b* of the stacked can merchandiser 10 to each other. FIG. 14 illustrates a cross-sectional view of the stacked can merchandiser 10 showing the interfit between of the snap lock feature 114 of the front engagement tab 20*a* and the snap lock feature 118 of the front interfit space 120. While the representative embodiment of the invention has the snap lock features 114, 118 on the front engagement tab 20*a* and front interlock space 110*b*, it is contemplated that the snap lock features 114, 188 may be located on any engagement tabs 20 or interlock spaces 110 along the length of the floor components 12.

There are virtually innumerable uses for the present invention, all of which need not be detailed here. Additionally, all the disclosed embodiments can be practiced without undue experimentation. Further, although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

In addition, the individual components of the present invention discussed herein need not be fabricated from the disclosed materials, but could be fabricated from virtually any suitable materials. Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A stacked can merchandiser comprising:

a floor component, the floor component having a glide surface allowing movement of merchandise;

a plurality of engagement tabs disposed on the sides of the floor component, the engagement tabs having a thickness equal to a thickness of the floor component, and at least one engagement tab including a snap lock feature formed in a side surface thereof;

a plurality of interfit spaces disposed on the sides of the floor component, at least one of the interfit spaces including a snap lock feature formed in a side surface thereof;

a divider extending upwardly from the floor component;

at least one finger element disposed at a front edge of the divider and extending laterally therefrom; and at least one pusher element coupled to the divider and configured to travel along a length of the divider.

2. The stacked can merchandiser of claim 1 wherein at least one of the plurality of engagement tabs is disposed on a first side of the floor component and at least one of the plurality of engagement tabs is disposed on a second side of the floor component.

3. The stacked can merchandiser of claim 1 further comprising a stopping element disposed at a leading end of the floor component.

4. The stacked can merchandiser of claim 1 wherein the floor component includes a divider support extending upwardly from the floor component and configured to couple with the divider.

5. The stacked can merchandiser of claim 1 wherein each divider includes at least one track channel, and wherein each of the at least one pusher element includes at least one tab, the at least one tab configured to slidably engage with a respective one of the at least one track channel.

6. The stacked can merchandiser of claim 1 further comprising at least one spring element, wherein each of the at least one spring element is coupled to a respective one of the at least one pusher element, and wherein the at least one spring element pushes its respective one of the at least one pusher element forward.

7. A stacked can merchandiser system comprising:

a first floor component having:

a first upper glide surface allowing movement of merchandise;

a first plurality of engagement tabs disposed on the sides of the first floor component, the engagement tabs having a thickness equal to a thickness of the first floor component, and wherein at least one of the engagement tabs includes a snap lock feature disposed thereon;

a first plurality of interfit spaces disposed on the sides of the first floor component, at least one of the interfit spaces including a snap lock feature;

a first divider extending upwardly from the first floor component, wherein the first divider is spaced apart from the sides of the first floor component;

a first finger element disposed at a front edge of the first divider and extending laterally therefrom;

a plurality of first retaining tabs disposed at the front edge of the first divider, extending laterally therefrom, and spaced vertically along the front edge of the first divider and below the first finger element; and a first pusher element coupled to the first divider and configured to travel along a length of the first divider.

8. The stacked can merchandiser system of claim 7 further comprising:

a second floor component having:

a second upper glide surface allowing movement of merchandise;

a second plurality of engagement tabs disposed on the sides of the second floor component, the engagement tabs having a thickness equal to a thickness of the second floor component, and wherein at least one of the engagement tabs includes a snap lock feature disposed thereon;

a second plurality of interfit spaces disposed on the sides of the second floor component, at least one of the interfit spaces including a snap lock feature;

a second divider extending upwardly from the second floor component, wherein the second divider is spaced apart from the sides of the second floor component;

a second finger element disposed at a front edge of the second divider and extending laterally therefrom;

a plurality of second retaining tabs disposed at the front edge of the second divider, extending laterally therefrom, and spaced vertically along the front edge of the second divider and below the second finger element; and a second pusher element coupled to the second divider and configured to travel along a length of the second divider;

wherein the snap lock feature of the at least one of the first plurality of engagement tabs is configured to interlock with the snap lock feature of the at least one of the second plurality of interfit spaces to couple the first and second floor components; and wherein the snap lock feature of the at least one of the first plurality of interfit spaces is configured to interlock with the snap lock feature of the at least one of the second plurality of engagement tabs to couple the first and second floor components.

9. The stacked can merchandiser system of claim 8 further comprising a can stacking area disposed between the first divider and second divider.

10. The stacked can merchandiser system of claim 7 further comprising a stopping element coupled to a leading end of the first floor component.

11. The stacked can merchandiser system of claim 7 wherein the first floor component includes a divider support extending upwardly from the first floor component, the divider support configured to vertically orient the first divider.

12. The stacked can merchandiser system of claim 7 wherein the first divider includes at least one track channel formed in a side of the first divider, and wherein the first pusher element includes at least one tab, the at least one tab configured to slidably engage with a respective one of the at least one track channel.

13. The stacked can merchandiser system of claim 7 further comprising a spring element coupled to the first pusher element and configured to push the first pusher member forward.

14. The stacked can merchandiser system of claim 7 wherein the first finger element comprises a first side prong and a second side prong, the first side prong extending laterally from a first side of the first divider, and the second prong extending laterally from a second side of the first divider.

15. The stacked can merchandiser system of claim 7 wherein the first finger element is larger than each of the plurality of retaining tabs.

16. A method of using a stacked can merchandiser system to display canned merchandise, the method comprising:

providing a first floor component;

coupling a second floor component to the first floor component, wherein a plurality of engagement tabs of the first floor component interfit with a plurality of interfit spaces of the second floor component, wherein a plurality interfit spaces of the first floor component interfit with a plurality of engagement tabs of the second floor component, wherein at least one of the engagement tabs of the first floor component includes a snap lock feature formed in a side surface thereof and configured to interfit with a snap lock feature formed in a side surface of at least one of the interfit spaces of the second floor component;

coupling a first divider to the first floor component;

coupling a second divider to the second floor component so that canned merchandise may be stacked between the first divider and the second divider;

stacking canned merchandise in a plurality of stacks between the first divider and the second divider;

pushing a first stack of the plurality of stacks of canned merchandise to a front edge of the first and second floor components by way of a pusher element that is slidably engaged with one of the first divider and the second divider; and stopping the canned merchandise at the front edge of the first and second floor components by way of at least one finger element disposed at each front edge of the first and second dividers and a plurality of retaining tabs disposed and each front edge of the first and second dividers, the at least one finger element and the plurality of retaining tabs being vertically spaced along each front edge of the first and second dividers.

17. The method of claim 16 further comprising stopping the canned merchandise at the front edge of the first and second floor components by way of a stopping element disposed at the leading end of the first and second floor components.

18. The method of claim 16 wherein coupling the first divider to the first floor component comprises inserting the first divider into a divider support extending vertically from the first floor component; and wherein coupling the second divider to the second floor component comprises inserting the second divider into a divider support extending vertically from the second floor component.

19. The method of claim 16 wherein pushing a first stack of the plurality of stacks of canned merchandise to a front edge of the first and second floor components by way of a pusher element further comprises using tension generated by a spring element coupled to the pusher member to push the canned merchandise to the front edge of the first and second floor components.

20. The method of claim 16 further comprising removing the first stack of the plurality of stacks of canned merchandise and pushing a second stack of the plurality of stacks of canned merchandise to the front edge of the first and second floor components by way of the pusher element.

* * * * *